US011217883B2

(12) United States Patent
Chiu et al.

(10) Patent No.: US 11,217,883 B2
(45) Date of Patent: Jan. 4, 2022

(54) ELECTRONIC DEVICE

(71) Applicant: InnoLux Corporation, Miao-Li County (TW)

(72) Inventors: Liang-Yun Chiu, Miao-Li County (TW); Tsung-Han Tsai, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 224 days.

(21) Appl. No.: 16/367,439

(22) Filed: Mar. 28, 2019

(65) Prior Publication Data

US 2020/0313289 A1 Oct. 1, 2020

(51) Int. Cl.
*H01Q 1/38* (2006.01)

(52) U.S. Cl.
CPC ..... *H01Q 1/38* (2013.01)

(58) Field of Classification Search
CPC ..... H01G 1/38
See application file for complete search history.

(56) References Cited

U.S. PATENT DOCUMENTS

2019/0115660 A1* 4/2019 Inukai ..... H01Q 3/36

* cited by examiner

*Primary Examiner* — Graham P Smith
(74) *Attorney, Agent, or Firm* — McClure, Qualey & Rodack, LLP

(57) ABSTRACT

An electronic device having a communication region and a peripheral region surrounding the communication region is provided. The electronic device includes a first substrate and a second substrate. The electronic device also includes a liquid-crystal layer disposed between the first substrate and the second substrate, a sealant enclosing the liquid-crystal layer, and a protruding layer disposed on one of the first substrate and the second substrate. The protruding layer is located in the communication region and the peripheral region.

19 Claims, 7 Drawing Sheets

ELECTRONIC DEVICE

BACKGROUND

Technical Field

Embodiments of the present disclosure relate to an electronic device. More specifically, the present disclosure relates to an electronic device including a protruding layer.

Description of the Related Art

In general, liquid crystal materials are used in liquid-crystal antenna devices to modulate radio frequency (RF) waves. However, the liquid crystal material located in the peripheral region has little effect on communication. Moreover, the electronic circuits in the peripheral region may be damaged by the liquid crystal material.

SUMMARY

In accordance with some embodiments of the present disclosure, an electronic device having a communication region and a peripheral region surrounding the communication region is provided. The electronic device includes a first substrate and a second substrate. The electronic device also includes a liquid-crystal layer disposed between the first substrate and the second substrate, a sealant enclosing the liquid-crystal layer, and a protruding layer disposed on one of the first substrate and the second substrate. The protruding layer may be located in the communication region and the peripheral region.

In accordance with some other embodiments of the present disclosure, an electronic device having a communication region and a peripheral region surrounding the communication region is provided. The electronic device includes a first substrate and a second substrate disposed opposite to the first substrate. The electronic device also includes a liquid-crystal layer disposed between the first substrate and the second substrate, and at least one antenna unit disposed in the communication region. The antenna unit includes an electrode disposed on one of the first substrate and the second substrate, a protruding layer, and an opening is disposed in the protruding layer. A portion of the electrode overlaps the opening from a top view.

BRIEF DESCRIPTION OF THE DRAWINGS

Aspects of the embodiments of the present disclosure are understood from the following detailed description when reading with the accompanying figures. It should be noted that, in accordance with the standard practice in the industry, various features are not drawn to scale. In fact, the dimensions of the various features may be arbitrarily increased or reduced for easy and clear discussion.

FIG. 2 is a partial cross-sectional view illustrating along line A-A' in FIG. 1.

DETAILED DESCRIPTION

Figure 1:
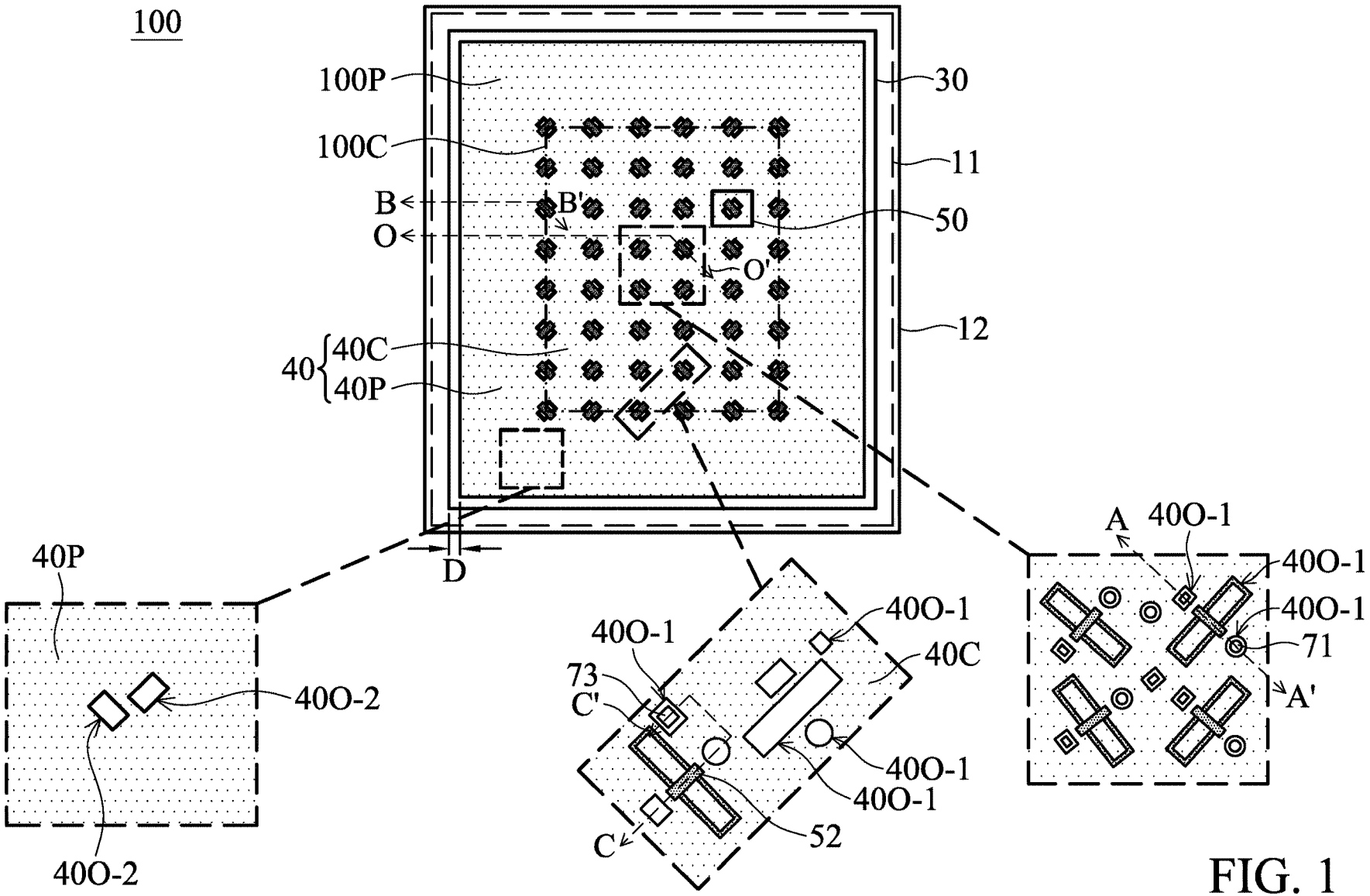
FIG. 1 is a partial top view illustrating an electronic device 100 according to one embodiment of the present disclosure.

The following disclosure provides many different embodiments, or examples, for implementing different features of the subject matter provided. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

It should be understood that additional steps may be implemented before, during, or after the illustrated methods, and some steps might be replaced or omitted in other embodiments of the illustrated methods.

Furthermore, spatially relative terms, such as "beneath," "below," "lower," "on," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 45 degrees or at other orientations) and the spatially relative descriptors used herein may likewise be interpreted accordingly.

In the present disclosure, the terms "about" and "substantially" typically mean +/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. That is, when there is no specific description of the terms "about" and "substantially", the stated value still includes the meaning of "about" or "substantially".

It should be understood that, although the terms "first," "second," "third," etc. can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Unless otherwise defined, all terms (including technical and scientific terms) used herein have the same meaning as commonly understood by one of ordinary skill in the art to which this disclosure belongs. It should be understood that terms such as those defined in commonly used dictionaries should be interpreted as having a meaning that is consistent with their meaning in the context of the relevant art and will not be interpreted in an idealized or overly formal sense unless expressly so defined in the embodiments of the present disclosure.

Figure 2:
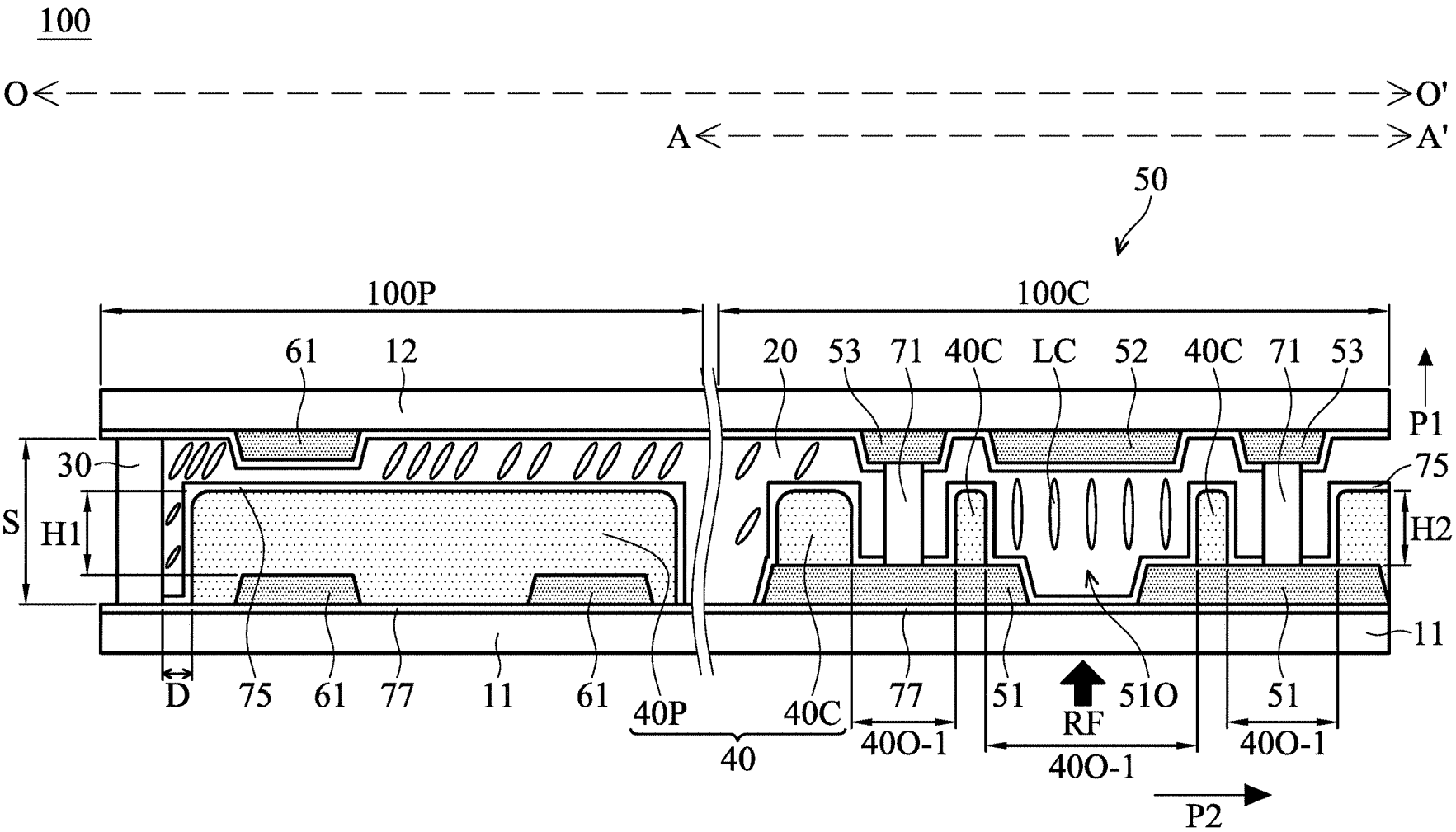
FIG. 2 is a partial cross-sectional view illustrating along line O-O' in FIG. 1.

FIG. 1 is a partial top view illustrating an electronic device 100 according to one embodiment of the present disclosure, and FIG. 2 is a partial cross-sectional view illustrating along line O-O' in FIG. 1. It should be noted that not all components of the electronic device 100 are shown in FIGS. 1-2, for the sake of brevity.

Referring to FIGS. 1 and 2, the electronic device 100 includes a first substrate 11 and a second substrate 12 facing the first substrate 11. In some embodiments, the material of the first substrate 11 or the second substrate 12 may include, but is not limited to, at least one of the following: ceramic, glass, polyimide (PI), liquid-crystal polymer (LCP), polycarbonate (PC), polypropylene (PP), polyethylene terephthalate (PET) (and other plastic), a polymer material, or a combination thereof. In some embodiments, the material of the first substrate 11 or the second substrate 12 may be elemental semiconductor substrates (which may include silicon, germanium), compound semiconductor substrates (which may include tantalum carbide, gallium arsenide, indium arsenide or indium phosphide), alloy semiconductor substrates (which may include silicon germanium, silicon germanium carbide, gallium arsenic phosphide or gallium indium phosphide), but the present disclosure is not limited thereto.

As shown in FIG. 2, in some embodiments, the electronic device 100 may include a liquid-crystal layer 20 disposed between the first substrate 11 and the second substrate 12. In some embodiments, the liquid-crystal layer 20 may include liquid crystal materials LC and/or other components according to the present disclosure. In some embodiments, the materials of the liquid-crystal layer 20 may include, but is not limited to, nematic liquid-crystal, smectic liquid-crystal, cholesteric liquid-crystal, blue phase liquid-crystal, highly anisotropic liquid-crystal, any other liquid-crystal material suitable for specific high frequency communication application, or a combination thereof.

As shown in FIG. 1 and FIG. 2, in some embodiments, the electronic device 100 may include a sealant 30 disposed between the first substrate 11 and the second substrate 12, and enclosing the liquid-crystal layer 20. That is, liquid crystal material LC of the liquid-crystal layer 20 may be enclosed by the sealant 30 (and between the first substrate 11 and the second substrate 12) to reduce leakage. In some embodiments, the material of the sealant 30 may include, but is not limited to, insulating transparent resin, epoxy resin, acrylic resin, UV-cured resin, any other suitable sealant material, or a combination thereof.

As shown in FIG. 1 and FIG. 2, in some embodiments, the electronic device 100 may be divided into a communication region 100C and a peripheral region 100P adjacent to the communication region 100C. Further, in some embodiments, the electronic device 100 may include at least one antenna unit 50 in the communication region 100C. In this embodiment, the electronic device 100 includes a plurality of antenna units 50 in the communication region 100C as shown in FIG. 1. It should be noted that the shape and the disposition of antenna units 50 shown in FIG. 1 is only exemplary, but the present disclosure is not limited thereto.

FIG. 2 is also a partial cross-sectional view illustrating along line A-A' in FIG. 1, which shows the cross-sectional view of at least one of the antenna unit 50. As shown in FIG. 2, the antenna unit 50 may include at least one first electrode 51 disposed on the first substrate 11, and a second electrode 52 and a plurality of contact pads 53 disposed on the second substrate 12. In the antenna unit 50 of this embodiment, the first electrode 51 may have openings 51O, and the second electrode 52 corresponds to one opening 51O. To be more specific, from the top view of the electronic device 100, a portion of the second electrode 52 may overlap the opening 51O, and the other portion of the second electrode 52 may overlap the first electrode 51. It should be noted that if the antenna unit 50 has two neighboring first electrodes 51, and the opening 51O is formed by the two neighboring first electrodes 51, then the second electrode 52 may overlap the two neighboring first electrodes 51.

In some embodiments, the antenna unit 50 may be defined as an electronic element which can receive or transmit radio frequency (RF, i.e., 3K-300 Ghz) electromagnetic waves. Moreover, the liquid crystal material LC contained between the first electrode(s) 51 and the second electrodes 52 may be used to modulate radio frequency (RF) electromagnetic waves.

In the embodiments of the present disclosure, the second electrode 52 corresponding to the opening 51O may be, but is not limited to, a patch electrode. In some embodiments, the communication region 100C of the electronic device 100 may be defined as the region containing at least one antenna unit 50, while the peripheral region 100P of the electronic device 100 may be defined as the region without antenna units 50 and adjacent to the communication region 100C. In some embodiments, the communication region 100C is surrounded by the peripheral region 100P. In some embodiments, the peripheral region 100P is enclosed by the sealant 30.

In some embodiments, the material of the first electrode(s) 51, the second electrode 52 and the contact pads 53 may be metal. For example, the material of the first electrode(s) 51, the second electrodes 52 and the contact pads 53 may include, but is not limited to, molybdenum, aluminum, copper, titanium, other suitable metal materials, or a combination thereof. In some embodiments, the material of the first electrode(s) 51, the second electrode 52 and the contact pads 53 may include, but is not limited to, conductive metal-oxide material like indium gallium zinc oxide (IGZO), gallium oxide, tin oxide, indium tin oxide (ITO) and indium zinc oxide (IZO), other suitable materials, or a combination thereof.

As shown in FIG. 1 and FIG. 2, the electronic device 100 may include a protruding layer 40 disposed on the first substrate 11, but the present disclosure is not limited thereto. In some embodiments, the protruding layer 40 may also be disposed on the second substrate 12. In some embodiments, a portion of the protruding layer 40 may be disposed on the first substrate 11, and the other portion of the protruding layer 40 may be disposed on the second substrate 12. In some embodiments, the protruding layer 40 may be located in the communication region 100C and the peripheral region 100P of the electronic device 100. In more detail, the protruding layer 40 may include a first portion 40C in the communication region 100C and a second portion 40P in the peripheral region 100P.

Figure 3:
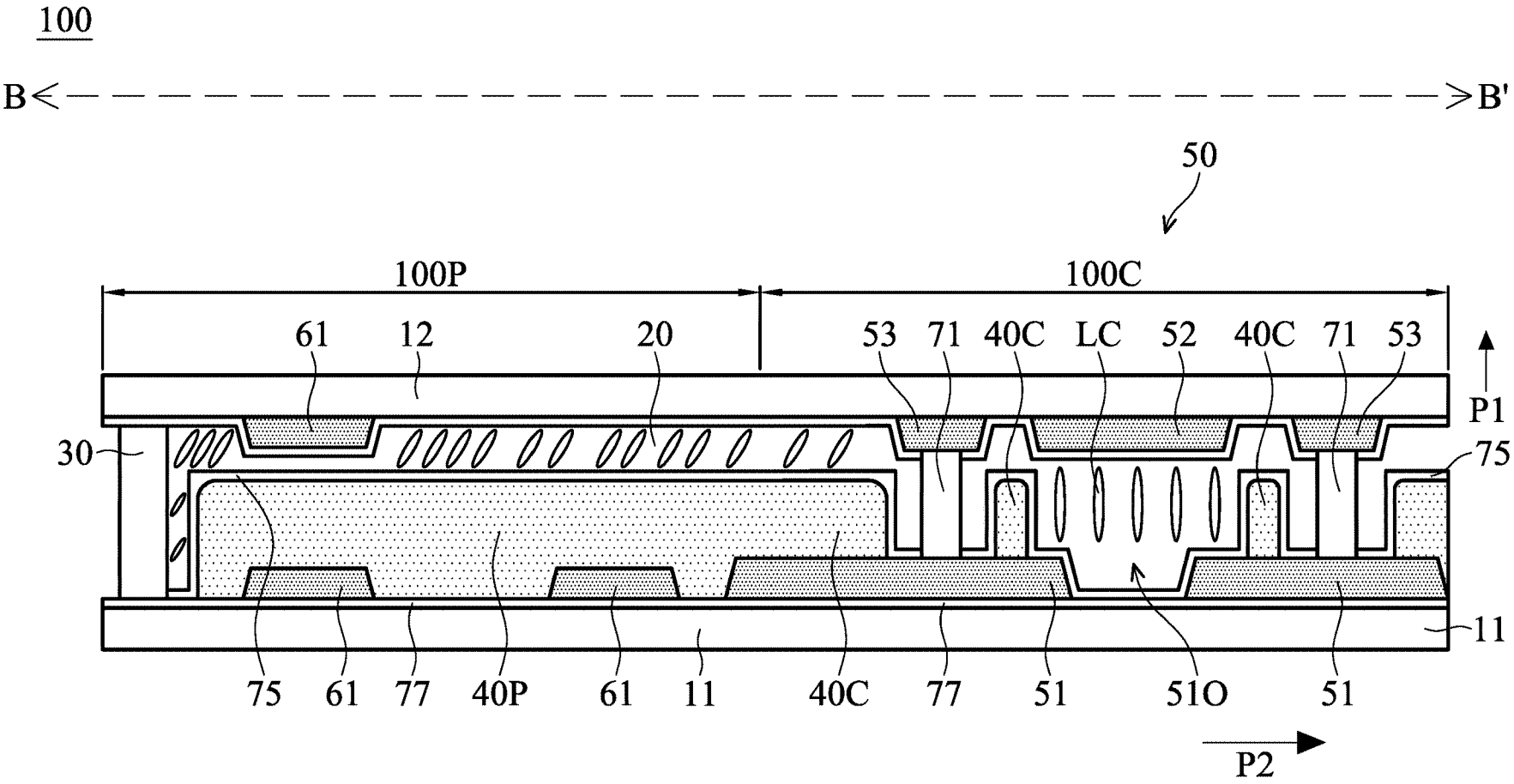
FIG. 3 is a partial cross-sectional view illustrating along line B-B' in FIG. 1 in one embodiment according to the present disclosure.

FIG. 3 is a partial cross-sectional view illustrating along line B-B' in FIG. 1 in one embodiment according to the present disclosure. It should be noted that not all components of the electronic device 100 are shown in FIG. 3, for the sake of brevity. As show in FIG. 3, the protruding layer 40 may extend from the communication region 100C to the peripheral region 100P of the electronic device 100. That is, first portion 40C of the protruding layer 40 may be connected to the second portion 40P of the protruding layer 40. However, the present disclosure is not limited thereto. In some embodiments, the first portion 40C of the protruding layer 40 may be disconnected from the second portion 40P of the protruding layer 40.

Figure 4:
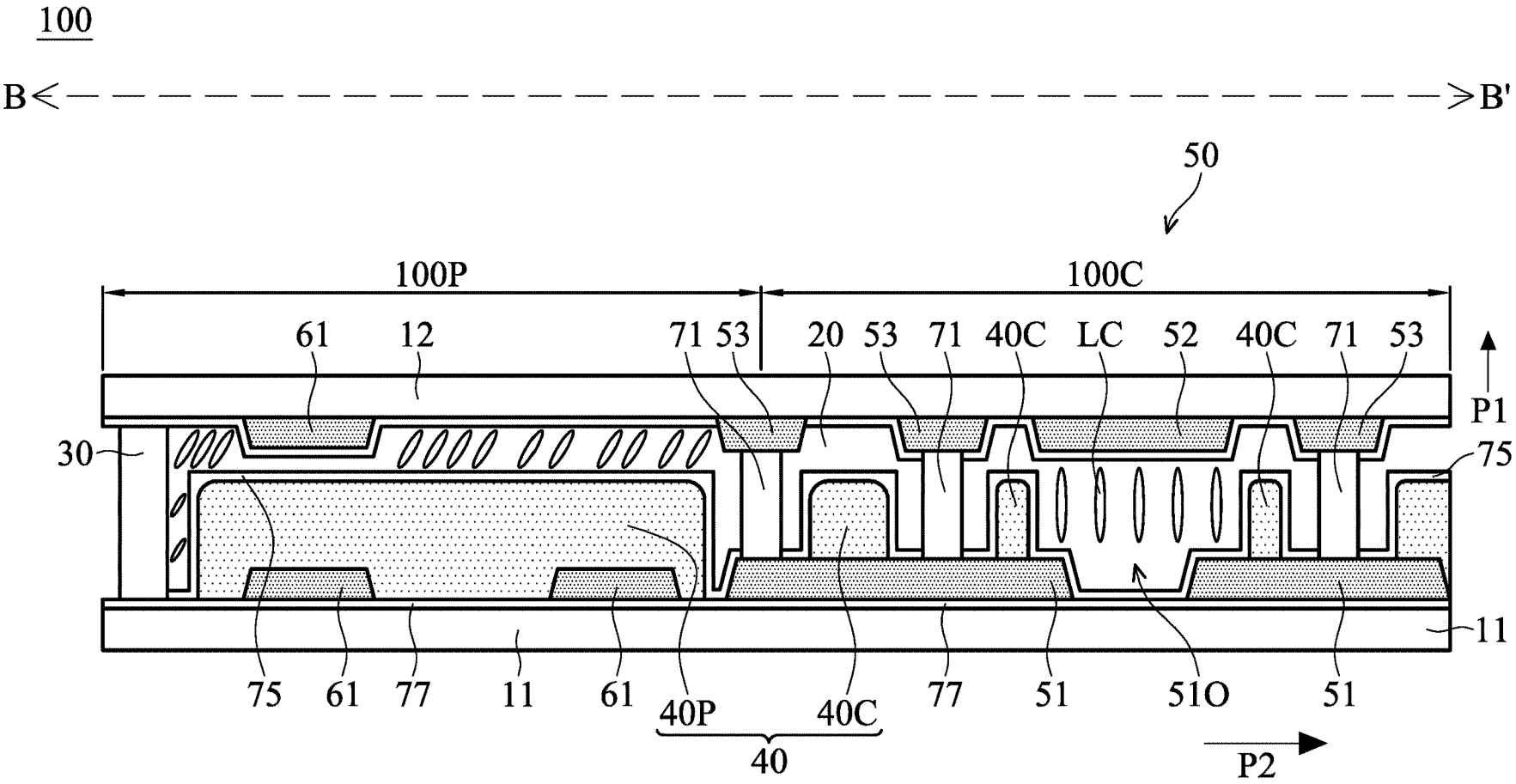
FIG. 4 is a partial cross-sectional view illustrating along line B-B' in FIG. 1 in another embodiment according to the present disclosure.

FIG. 4 is a partial cross-sectional view illustrating along line B-B' in FIG. 1 in another embodiment according to the present disclosure. It should be noted that in the embodiment of FIG. 4, the first portion 40C of the protruding layer 40 may be disconnected from the second portion 40P of the protruding layer 40.

In some embodiments, the protruding layer 40 may be a single-layered structure; in other embodiments, the protruding layer 40 may be a multi-layered structure. In some embodiments, the material of the protruding layer 40 may include, but is not limited to, benzophenone, benzophenone tetracarboxylic dianhydride (BTDA), Phenol formaldehyde resins (PF), polyimide (PI), epoxy resin, acrylic resin (e.g., polymethylmetacrylate (PMMA)), benzocyclobutene (BCB), polyester, polydimethylsiloxane (PDMS), polytetrafluoroethylene (PFA) or a combination thereof.

As shown in FIG. 1 and FIG. 2, the sealant 30 may be separated from the protruding layer 40 in the peripheral region 100P. In some embodiments, the distance D between the inner edge of the sealant 30 and the outer edge of the protruding layer 40 in the peripheral region 100P (i.e., the outer edge of the second portion 40P of the protruding layer 40) may be greater than or equal to 0.05 mm and less than or equal to 5 mm, but the present disclosure is not limited thereto.

Since the sealant 30 may be separated from the protruding layer 40 in the peripheral region 100P, the sealant 30 will not overlap the protruding layer 40. It therefore may reduce liquid crystal material LC leakage, and reduce the probability that the first substrate 11 or the second substrate 12 is damaged during the assembling process.

Moreover, the protruding layer 40 in the peripheral region 100P may occupy most spaces between the first substrate 11 and the second substrate 12, so that the amount of liquid crystal material located in the peripheral region (which has little effect on communication) may be reduced. Furthermore, the protruding layer 40 in the peripheral region 100P may cover the electronic elements 61, such as integrated circuits (IC), chip on glass (COG), gate driver on array (GOA) circuits, electrodes, wirings, etc. Therefore, it may reduce the probability that the electronic elements 61 are damaged by the liquid crystal material.

As shown in FIG. 2, in the peripheral region 100P, the thickness H1 of the protruding layer 40 (second portion 40P) is in a range greater than or equal to 0.5 μm, and less than or equal to 10 μm ($0.5 \leq H1 \leq 10$ μm). The thickness H1 may be less than the thickness S of the sealant 30. In some embodiments, the thickness H1 of the protruding layer 40 may be measured in a cross-sectional view, and the thickness H1 may be defined as the maximum thickness between the top surface of the second portion 40P of the protruding layer 40 and the top surface of the electronic elements 61 in the direction P1 perpendicular to the first substrate 11. Similarly, the thickness S of the sealant 30 may be measured in a cross-sectional view, and in some embodiments, the thickness S may be defined as the maximum thickness between the top surface and the bottom surface of the sealant 30 in the direction P1 perpendicular to the first substrate 11. In some embodiments, the ratio of the thickness H1 of the protruding layer 40 in the peripheral region 100P to the thickness S of the sealant 30 may be greater than 0, and less than or equal to 0.8 ($0 < H1/S \leq 0.8$).

Moreover, the thickness H1 of the protruding layer 40 (second portion 40P) in the peripheral region 100P may be greater than the thickness H2 of the protruding layer 40 (first portion 40C) in the communication region 100C as shown in FIG. 2. Similarly, the thickness H2 of the protruding layer 40 may be the maximum thickness measured from the top surface of the first electrode 51 to the top surface of first portion 40C of the protruding layer 40 in a cross-sectional view. In some embodiments, the ratio of the thickness H2 of the protruding layer 40 (first portion 40C) in the communication region 100C to the thickness H1 of the protruding layer 40 (second portion 40P) in the peripheral region 100P may be greater than 0, and less than or equal to 0.5 ($0 < H2/H1 \leq 0.5$).

As shown in FIG. 1, the protruding layer 40 may include a plurality of first openings 40O-1 in the communication region 100C, and a plurality of second openings 40O-2 in the peripheral region 100P. In some embodiments, there are more first openings 40O-1 than second openings 40O-2, but the present disclosure is not limited thereto.

Figure 5:
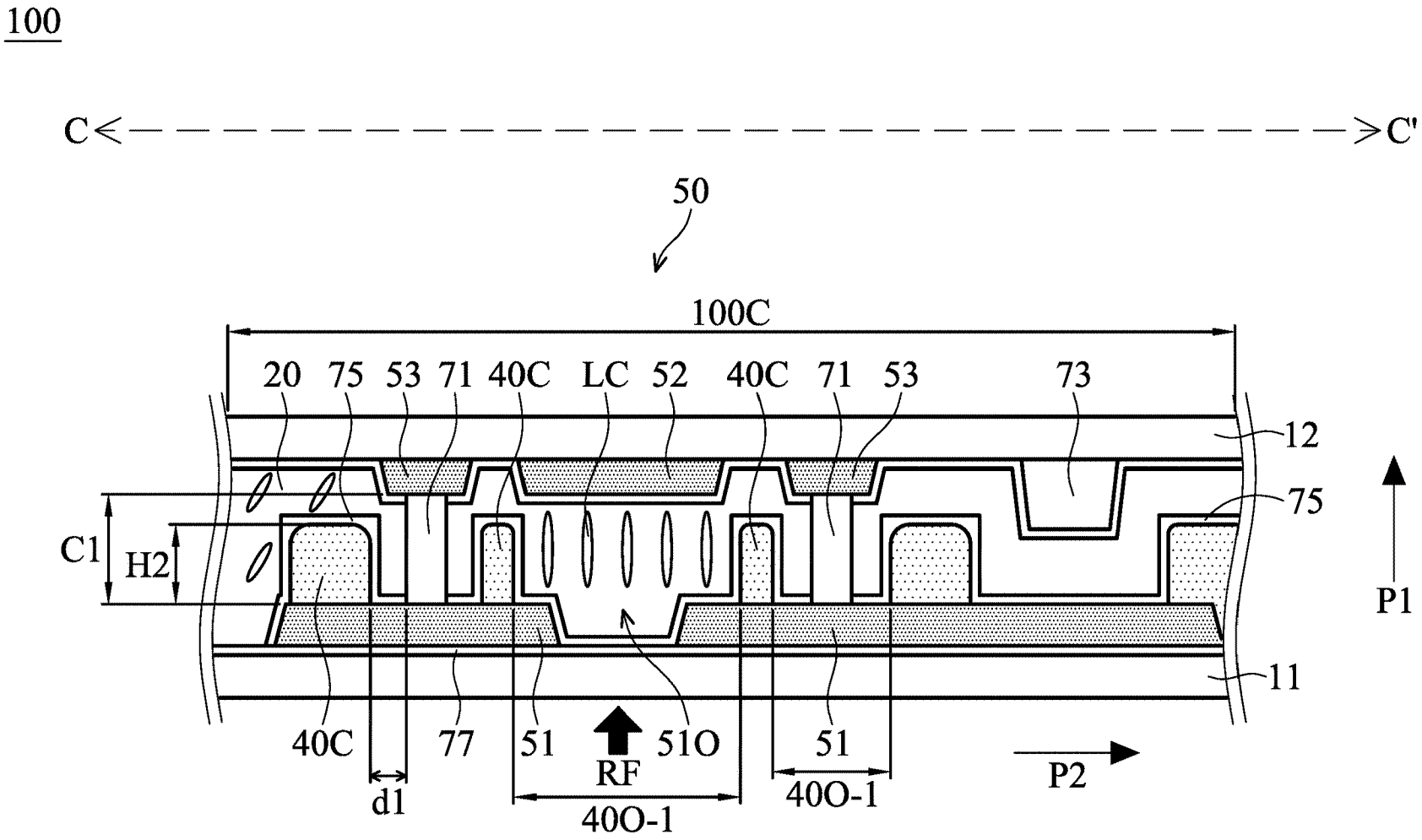
FIG. 5 is a partial cross-sectional view illustrating along line C-C' in FIG. 1.

FIG. 5 is a partial cross-sectional view illustrating along line C-C' in FIG. 1. It should be noted that not all components of the electronic device 100 are shown in FIG. 5, for the sake of brevity. In some embodiments, the electronic device 100 may further include at least one spacer 71 disposed between the first substrate 11 and the second substrate 12. As shown in FIG. 1, FIG. 2, and FIG. 5, the electronic device 100 may include spacers 71 disposed between the first electrode 51 and the contact pad 53. In more detail, from the top view of the electronic device 100, the spacer 71 may overlap one of the first openings 40O-1, and in some embodiments, the spacer 71 may overlap one of the second openings 40O-2.

In some embodiments, the spacers 71 may be used to maintain the gap between the first substrate 11 and the second substrate 12. For example, the spacers 71 may be cell gap spacers, such as ball spacers, photo spacers, glass fibers, other suitable spacers, or a combination thereof.

As shown in FIG. 5, the spacer 71 may be separated from the protruding layer 40 in the communication region 100C. In some embodiments, a distance d1 between the spacer 71 and the protruding layer 40 in the direction P2 parallel to the first substrate 11 (or the second substrate 12) may be greater than 0.01 mm, and less than 2 mm ($0.01 \text{ mm} < d1 < 2 \text{ mm}$). It should be noted that the distance d1 may be measured in a cross-sectional view, and in some embodiments, the distance d1 may be the minimum distance between the spacer 71 and the protruding layer 40, but the present disclosure is not limited thereto.

In some embodiments, the ratio of the thickness C1 of the spacer 71 to the thickness H2 of the protruding layer 40 (first portion 40C) may be greater than 0, and less than or equal to 1.5 ($0 < C1/H2 \leq 1.5$) in the communication region 100C. In some embodiments, the ratio of the thickness C1 of the spacer 71 to the thickness H2 of the protruding layer 40 (first portion 40C) may be greater than or equal to 0.6, and less than or equal to 1.3 ($0.6 \leq C1/H2 \leq 1.3$). Similarly, the thickness C1 of the spacer 71 may be defined as the maximum distance between the top surface and the bottom surface of the spacer 71 in the direction P1 perpendicular to the first substrate 11.

In some embodiments, the spacer 71 is used to control the cell gap (i.e., the distance between the surfaces of the first electrode 51 and the surface second electrode 52 in the direction P1 perpendicular to the first substrate 11). That is, the thickness C1 of the spacer 71 may be substantially the same as the cell gap of the antenna unit 50, and the ratio of the cell gap of the antenna unit 50 to the thickness H2 of the protruding layer 40 (first portion 40C) may be greater than 0, and less than or equal to 1.5. In some embodiments, the ratio of the cell gap of the antenna unit 50 to the thickness H2 of the protruding layer 40 (first portion 40C) may be greater than or equal to 0.6, and less than or equal to 1.3.

In some embodiments, the electronic device 100 may further include a transistor 73 disposed on the second substrate 12 as shown in FIG. 5. However, the present disclosure is not limited thereto. In other embodiments, the transistor 73 may be disposed on the first substrate 11. In some embodiments, the transistor 73 may be an element including at least one transistor, such as integrated circuit, complementary metal-oxide-semiconductor (CMOS) device, high electron mobility transistor (HEMT) device, but the present disclosure is not limited thereto.

Moreover, from the top view of the electronic device 100, the transistor 73 may overlap one of the first openings 40O-1 in the communication region 100C. However, the present disclosure is not limited thereto. In other embodiments, the transistor 73 may overlap one of the second openings 40O-2 in the peripheral region 100P.

In some embodiments, the transistor 73 may be connected to the transmitter (Tx) and/or receiver (Rx) (e.g., second electrode 52), such that the antenna unit 50 may be controlled independently, but the present disclosure is not limited thereto.

Figures 6A, 6B, 6C:
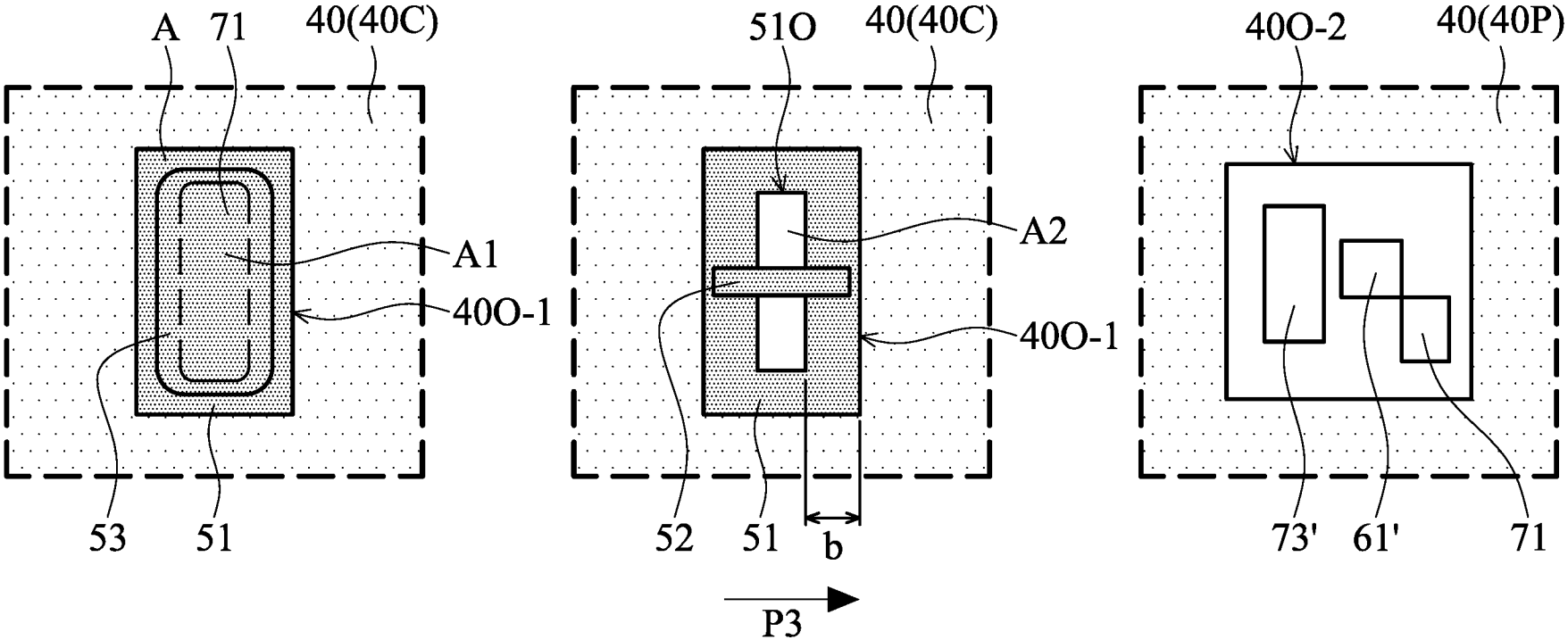
FIG. 6A is a partial top view illustrating a first openings of the protruding layer in the communication region according to one embodiment of the present disclosure.
FIG. 6B is a partial top view illustrating a first openings of the protruding layer in the communication region according to another embodiment of the present disclosure.
FIG. 6C is a partial top view illustrating a second openings of the protruding layer in the peripheral region 100P according to one embodiment of the present disclosure.

FIG. 6A is a partial top view illustrating a first openings 40O-1 of the protruding layer 40 in the communication region 100C according to one embodiment of the present disclosure. FIG. 6B is a partial top view illustrating a first openings 40O-1 of the protruding layer 40 in the communication region 100C according to another embodiment of the present disclosure. FIG. 6C is a partial top view illustrating a second openings 40O-2 of the protruding layer 40 in the peripheral region 100P according to one embodiment of the present disclosure. It should be noted that not all components are shown in FIGS. 6A-6C, for the sake of brevity.

As shown in FIG. 6A and FIG. 6B, the area A of the first opening 40O-1 projected onto the first substrate 11 (or onto the second substrate 12) may be larger than the area A1 of the spacer 71 projected onto the first substrate 11 (or onto the second substrate 12) regardless of the shape or the position of the spacer 71. In some embodiments, the ratio of the area A1 to the area A (A1/A) may be greater than 0 and less than 1 ($0<A1/A<1$).

Moreover, the area A of the first opening 40O-1 projected onto the first substrate 11 (or onto the second substrate 12) may be larger than the area A2 of the opening 510 (which may be formed by the first electrode(s) 51) projected onto the first substrate 11 (or onto the second substrate 12). In some embodiments, the ratio of the area A2 to the area A (A2/A) may be greater than 0 and less than 0.7 ($0<A2/A<0.7$).

In some embodiments, as shown in FIG. 6B, the distance b between the border of the opening 510 (which may be formed by the first electrode(s) 51) and the border of the first opening 40O-1 in the direction P3 parallel to the extension direction of the second electrode 52 may be greater than 0 and less than 10 mm ($0<b<10$ mm) for reducing the effect of the electromagnetic field (from outside) on the radio frequency (RF) waves, but the present disclosure is not limited thereto.

As shown in FIG. 6C, from a top view, a transistor 73' and the electronic element 61' may be disposed inside the second opening 40O-2. In some embodiments, the electronic element 61' may be a sensor, a signal amplifier, a signal processor, an alignment mark, a testing electrode or a dummy electrode for simulating the circuits related to the functions of the antenna, but the present disclosure is not limited thereto. In some embodiments, a spacer 71 may be disposed in the second opening 40O-2.

As shown in FIGS. 2 to 5, in some embodiments, the electronic device 100 may further include a first insulating layer 75 disposed on at least a portion of the surface of the protruding layer 40, and disposed on a portion of the surface of the first substrate 11 or the surface of the second substrate 12. Referring to FIGS. 2 to 5, in the communication region 100C, the first portion 40C of the protruding layer 40 may be disposed between the first insulating layer 75 and the first electrode 51; in the peripheral region 100P, a part of the second portion 40P of the protruding layer 40 may be disposed between the first insulating layer 75 and the electronic elements 61, and the other part of the second portion 40P of the protruding layer 40 may be disposed between the first insulating layer 75 and the first substrate 11. That is, the first insulating layer 75 may fully or partially cover the protruding layer 40.

The first insulating layer 75 may be used for liquid-crystal alignment. In some embodiments, the material of the first insulating layer 75 may include, but is not limited to, polyimide (PI), epoxy resin, acrylic resin (e.g., polymethylmetacrylate (PMMA)), benzocyclobutene (BCB), polyester, polydimethylsiloxane (PDMS), polytetrafluoroethylene (PFA), silicon oxide (SiOx), silicon nitride (SiNx), or a combination thereof.

In some embodiments, the thickness of the first insulating layer 75 may be greater than or equal to 10 nm, and less than 500 nm (10 nm≤thickness≤500 nm). In some embodiments, the thickness of the first insulating layer 75 may be defined as the minimum thickness of the portion of the first insulating layer 75 disposed on the top surface of the protruding layer 40 in the direction P1 perpendicular to the first substrate 11 It should be noted that the thickness may be measured in a cross-sectional view.

In some embodiments, the electronic device 100 may further include a second insulating layer 77 disposed on the surface of either the first substrate 11 or the second substrate 12. In some embodiments, a portion of the protruding layer 40 may be in direct contact with the second insulating layer 77. Referring to FIGS. 2 to 5, in the communication region 100C, the second insulating layer 77 may be disposed between the first substrate 11 and the first electrode 51; in the peripheral region 100P, the second insulating layer 77 may be disposed between the first substrate 11 and the electronic elements 61, but the present disclosure is not limited thereto.

In some embodiments, the material of the second insulating layer 77 may include, but is not limited to, polyimide (PI), epoxy resin, acrylic resin (e.g., polymethylmetacrylate (PMMA)), benzocyclobutene (BCB), polyester, polydimethylsiloxane (PDMS), polytetrafluoroethylene (PFA), silicon oxide (SiOx), silicon nitride (SiNx), or a combination thereof. In some embodiments, the second insulating layer 77 may be used for the electronic device 100 from warpage during the manufacturing process, but the present disclosure is not limited thereto.

Figure 7:
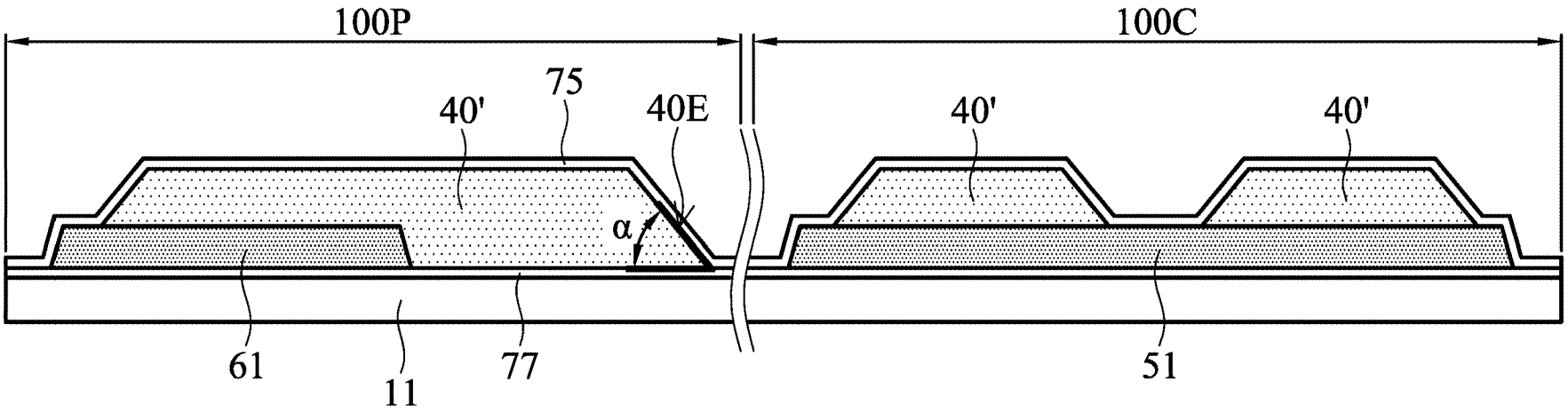
FIG. 7 is a partial cross-sectional view illustrating a protruding layer according to another embodiment of the present disclosure.

The protruding layers 40 described in the embodiments above are illustrated to have straight edges. However, the present disclosure is not limited thereto. FIG. 7 is a partial cross-sectional view illustrating a protruding layer 40' according to another embodiment of the present disclosure. As shown in FIG. 7, the protruding layer 40' may have an oblique edge 40E. In this embodiment, the included angle $\alpha$ between the extension line of the oblique edge 40E and a surface of the first substrate 11 (or the second substrate 12) may be greater than or equal to 20 degrees, and less than or equal to 130 degrees (20 degrees$\leq\alpha\leq$130 degrees), but the present disclosure is not limited thereto. In some embodiments, the protruding layer may have a curved edge in a cross-sectional view.

Furthermore, the sealant 30 in FIG. 1 is illustrated to have a rectangular shape. However, the present disclosure is not limited thereto. In some embodiments, the sealant 30 may be formed into a closed polygon (e.g., triangle, pentagon, hexagon, etc.), a circle, or other irregular closed shapes. It should be noted that when the electronic device and the space enclosed by the sealant 30 have arbitrary shapes, the distance D between the inner edge of sealant 30 and the outer edge of protruding layer 40 in the peripheral region 100P (i.e., the second portion 40P of the protruding layer 40) may be kept in the range of greater than or equal to 0.05 mm and less than or equal to 5 mm (0.05 mm$\leq$D$\leq$5 mm). To measure the distance D, a base point in sealant 30 is selected, and a base line is selected to extend from the base point and to be perpendicular to the extension direction of the sealant 30' the base line will intersect the inner edge of sealant 30 at point A and intersect the outer edge of protruding layer 40 at point B, the distance between point A and point B is the distance D.

Furthermore, the shape and area of 40O-1 and 40O-2 shown in aforementioned embodiments are only exemplary, and may be varied depending on the demand. In some embodiments of the present disclosure, the protruding layer 40 may be designed to have free-shape openings, the area of the free-shape opening may be larger than the area of one of the openings shown in FIGS. 6A to 6C, and the shape of free-shape opening may be arbitrary. In the free-shape openings of the communication region 100C, more area of the first electrode 51 may be exposed. In the free-shape openings of the peripheral region 100P, the spacers 71, the transistors 73' and the electronic elements 61 may be placed in the free-shape openings. It should be noted that in the free-shape openings, the distance d1 is defined to be the shortest distance between the spacer 71 and the nearest part of protruding layer 40, and the distance d1 may be greater than 0.01 mm, and less than 2 mm (0.01 mm<d1<2 mm).

In summary, the protruding layer in the peripheral region of the embodiments according to the present disclosure may occupy most spaces between the first substrate and the second substrate, so that the amount of liquid crystal material located in the peripheral region (which has little effect on communication) may be reduced. Furthermore, the protruding layer in the peripheral region may cover the electronic elements. Therefore, it may reduce the probability that electronic elements are damaged by the liquid crystal material.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure. Therefore, the scope of protection should be determined by the claims. In addition, although some embodiments of the present disclosure are disclosed above, they are not intended to limit the scope of the present disclosure.

Reference throughout this specification to features, advantages, or similar language does not imply that all of the features and advantages that may be realized with the present disclosure should be or are in any single embodiment of the disclosure. Rather, language referring to the features and advantages is understood to mean that a specific feature, advantage, or characteristic described in connection with an embodiment is included in at least one embodiment of the present disclosure. Thus, discussions of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize, in light of the description herein, that the disclosure can be practiced without one or more of the specific features or advantages of a particular embodiment. In other instances, additional features and advantages may be recognized in certain embodiments that may not be present in all embodiments of the disclosure.

What is claimed is:

1. An electronic device having a communication region and a peripheral region surrounding the communication region, comprising:

a first substrate;

a second substrate;

a liquid-crystal layer disposed between the first substrate and the second substrate;

a sealant enclosing the liquid-crystal layer; and a protruding layer disposed on one of the first substrate and the second substrate;

wherein the protruding layer is located in the communication region and the peripheral region and the sealant spaces apart the protruding layer in the peripheral region.

2. The electronic device according to claim 1, wherein a distance between the sealant and the protruding layer in the peripheral region is greater than or equal to 0.05 mm and less than or equal to 5 mm.

3. The electronic device according to claim 1, wherein the protruding layer is extended from the communication region to the peripheral region.

4. The electronic device according to claim 1, wherein the protruding layer comprises a first portion in the communication region and a second portion in the peripheral region, and the first portion is disconnected from the second portion.

5. The electronic device according to claim 1, wherein the protruding layer comprises:

a plurality of first openings in the communication region; and a plurality of second openings in the peripheral region;

wherein a number of the plurality of first openings is greater than a number of the plurality of second openings.

6. The electronic device according to claim 5, further comprising:

a spacer disposed between the first substrate and the second substrate, wherein the spacer overlaps one of the plurality of first openings or one of the plurality of second openings from a top view.

7. The electronic device according to claim 5, further comprising:

a transistor overlapping one of the plurality of first openings or one of the plurality of second openings from a top view.

8. The electronic device according to claim 1, wherein the communication region comprises at least one antenna unit.

9. The electronic device according to claim 8, wherein the at least one antenna unit comprises an opening and an electrode, and a portion of the electrode overlaps the opening from a top view.

10. The electronic device according to claim 1, further comprising:

a plurality of first electrodes disposed on a surface of the first substrate;

a plurality of second electrodes disposed on a surface of the second substrate; and at least one spacer disposed between one of the plurality of first electrodes and one of the plurality of second electrodes;

wherein a portion of the protruding layer is between a portion of the plurality of first electrodes and a portion of the plurality of second electrodes.

11. The electronic device according to claim 1, wherein a thickness of the protruding layer in the peripheral region is greater than or equal to 0.5 μm, and less than or equal to 10 μm.

12. The electronic device according to claim 1, further comprising an insulating layer disposed on at least a portion of a surface of the protruding layer, and disposed on a portion of a surface of the first substrate or a surface of the second substrate.

13. The electronic device according to claim 12, wherein a thickness of the insulating layer is greater than or equal to 10 nm, and less than 500 nm.

14. The electronic device according to claim 12, wherein a material of the insulating layer comprises polyimide (PI), epoxy resin, acrylic resin, benzocyclobutene (BCB), polyester, polydimethylsiloxane (PDMS), polytetrafluoroethylene (PFA) , silicon oxide (SiOx), or silicon nitride (SiNx).

15. The electronic device according to claim 1, wherein a ratio of a thickness of the protruding layer in the peripheral region to a thickness of the sealant is greater than 0, and less than or equal to 0.8.

16. The electronic device according to claim 1, wherein a ratio of a thickness of the protruding layer in the communication region to a thickness of the protruding layer in the peripheral region may be greater than 0 and less than or equal to 0.5.

17. The electronic device according to claim 1, wherein the protruding layer has a first edge, and an included angle between an extension line of the first edge and a surface of one of the first substrate and the second substrate is greater than or equal to 20 degrees, and less than or equal to 130 degrees.

18. The electronic device according to claim 1, wherein a material of the protruding layer comprises benzophenone, benzophenone tetracarboxylic dianhydride (BTDA), phenol formaldehyde resins (PF), polyimide (PI), epoxy resin, acrylic resin, benzocyclobutene (BCB), polyester, polydimethylsiloxane (PDMS), or polytetrafluoroethylene (PFA).

19. An electronic device having a communication region and a peripheral region surrounding the communication region, comprising:

a first substrate;

a second substrate disposed opposite to the first substrate;

a liquid-crystal layer disposed between the first substrate and the second substrate; and a sealant enclosing the liquid-crystal layer;

a first portion of a protruding layer disposed on one of the first substrate and the second substrate, wherein the sealant spaces apart the first portion of the protruding layer in the peripheral region; and at least one antenna unit disposed in the communication region, wherein the at least one antenna unit comprises:

an electrode disposed on one of the first substrate and the second substrate;

a second portion of the protruding layer; and an opening disposed in the second portion of the protruding layer;

wherein a portion of the electrode overlaps the opening from a top view.

* * * * *